US006095118A

United States Patent [19]

Klinger et al.

[11] Patent Number: 6,095,118

[45] Date of Patent: Aug. 1, 2000

[54] FUEL INJECTOR

[75] Inventors: Horst Klinger, Ludwigsburg; Uwe Kuhn, Riederich; Bernd Rosenau, Tamm; Peter Traub; Gerd Loesch, both of Stuttgart; Sandro Soccol, Bietigheim-Bissingen, all of Germany

[73] Assignee: Robert Bosch GmbH, Stuttgart, Germany

[21] Appl. No.: 09/101,620

[22] PCT Filed: Jun. 30, 1997

[86] PCT No.: PCT/DE97/01370

§ 371 Date: Mar. 24, 1999

§ 102(e) Date: Mar. 24, 1999

[87] PCT Pub. No.: WO98/21470

PCT Pub. Date: May 22, 1998

[30] Foreign Application Priority Data

Nov. 12, 1996 [DE] Germany ..... 196 46 581

[51] Int. Cl.[7] ..... F02M 37/04

[52] U.S. Cl. ..... 123/446; 123/447; 123/456; 123/506

[58] Field of Search ..... 123/446–7, 456, 123/506, 458, 198 D

[56] References Cited

U.S. PATENT DOCUMENTS

| | | | |
|---|---|---|---|
| 4,777,921 | 10/1988 | Miyaki et al. | 123/458 |
| 5,058,553 | 10/1991 | Kondo et al. | 123/446 |
| 5,197,438 | 3/1993 | Yamamoto | 123/456 |
| 5,201,294 | 4/1993 | Osuka | 123/458 |
| 5,277,156 | 1/1994 | Osuka et al. | 123/198 DB |

FOREIGN PATENT DOCUMENTS

| | | |
|---|---|---|
| 0243871 | 11/1987 | European Pat. Off. . |
| 0507191A | 10/1992 | European Pat. Off. . |

*Primary Examiner*—Thomas N. Moulis
*Attorney, Agent, or Firm*—Ronald E. Greigg; Edwin E. Greigg

[57] ABSTRACT

A fuel injection system for internal combustion engines is proposed, in which with the aid of a high-pressure pump fuel is pumped at high pressure into a high-pressure fuel reservoir (6), from which electrically controlled fuel injection valves (9) are supplied. The pressure in the high-pressure fuel reservoir is maintained in such a way that a first pump element (16) pumps fuel into the high-pressure reservoir with a variable pumping quantity, and a second pump element (17) as needed pumps a constant high-pressure fuel quantity into the high-pressure reservoir. A simple, economical system is thus obtained for furnishing high fuel pressure for injection by the fuel injection system (FIG. 2).

20 Claims, 3 Drawing Sheets

FUEL INJECTOR

PRIOR ART

The invention is based on a fuel injection system for an internal combustion engine. In one such fuel injection system, known from European Patent Disclosure EP B1 0 243 871, an in-line injection pump that has three pump pistons with corresponding pump work chambers is provided for supplying pressure to the high-pressure fuel reservoir. Each of these pump pistons pumps fuel into the high-pressure fuel reservoir with a regulated quantity, and the high-pressure pumping of fuel injection quantities is effected by one magnet valve for each cylinder, controlled by an electric control unit, each valve being disposed in a relief line of the respective pump work chamber and on closing determining the phase of the high-pressure pumping. In the intake stroke, the applicable pump work chamber is made to communicate with a fuel inlet by means of a control edge moved by the piston, so that the pump work chamber at bottom dead center is entirely filled with fuel. The pump pistons are driven by multiple cams, in such a way that they have their high-pressure pumping phase in synchronism with the applicable fuel injection point of the individual fuel injection valves, and thus an approximately equal pressure in the high-pressure fuel reservoir can be established. With the aid of a pressure sensor, this pressure is detected, and in accordance with a set-point value, the electric control unit outputs a control signal to the respective magnet valves.

This arrangement has the disadvantage of requiring very complicated and expensive control for each pump element of the high-pressure pump. Changing the pressure in the high-pressure reservoir can then be done only whenever high-pressure fuel injection is taking place, so that a spontaneous change to a higher pressure level in the high-pressure fuel reservoir can be accomplished with a delay. To effect a change of pressure in the reservoir, the pressure can rise only during the injection. This results in an undefined status of the reservoir pressure during injection, making it difficult to determine the correct injection quantity as a summation effect of pressure prevailing at a particular metering cross section and of time.

ADVANTAGES OF THE INVENTION

By means of the fuel injection system of the invention, the advantage is obtained that by operating the pump elements on and off, this second pump element being operated at a constant high-pressure pumping quantity, very simple regulation of the pressure in the high-pressure fuel reservoir can be attained. In particular, by turning on the pump element that operates at a constant high-pressure pumping quantity, a fast and spontaneous pressure increase in the high-pressure fuel reservoir is attained, so that changing operating conditions can be reacted to quickly. It is particularly advantageous that when the second of the pump elements, in a period of time located between the fuel injection events of the individual fuel injection valves, is already pumping, the pressure level can be changed from a first value to a second value early, and that then by means of the pump elements that pump fuel with a variable fuel pumping quantity, the pressure level can be kept constant in the operating range within which the injections take place. A stable reservoir pressure during injection is thus attained. To carry out the pressure increase, the second pump element is operated for only a relatively short portion of the total operating time of the fuel injection pump under operating conditions and can advantageously be designed for a shorter service life.

Moreover, pressure fluctuations in the high-pressure reservoir are advantageously avoided both in the version set forth herein. It is also advantageous if the drive cams driven in synchronism with the engine are embodied as multiple cams, in particular triple cams, so that a high number of strokes per revolution is attainable even if there are only a few pump elements.

BRIEF DESCRIPTION OF THE DRAWING

One exemplary embodiment of the invention is shown in the drawings and will be described in further detail below. Shown are FIG. 1, a schematic illustration of the fuel injection system.

DETAILED DESCRIPTION

Figure 1:
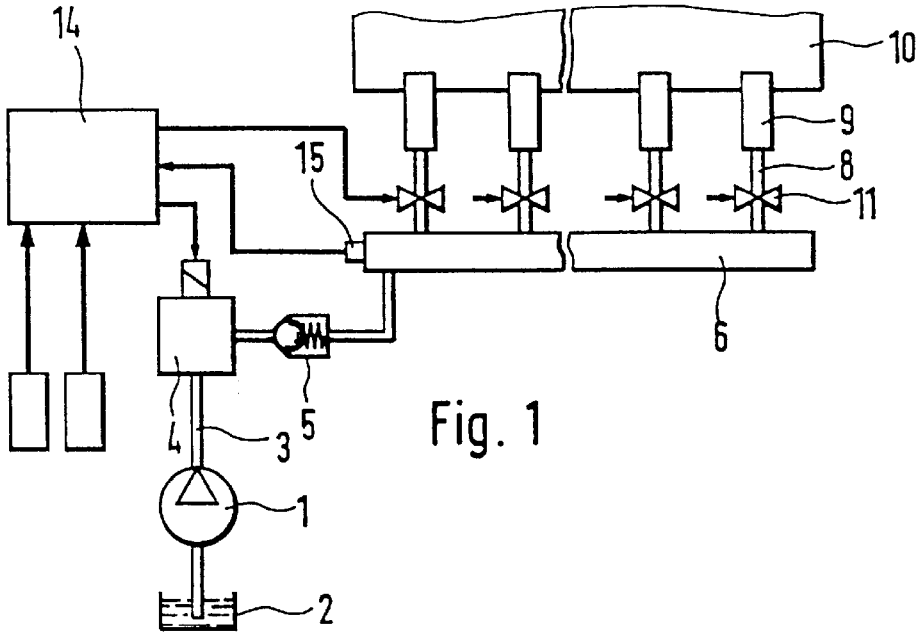

A fuel injection system of the type according to the invention has a high-pressure pump 1, which is driven with a rotary speed synchronized with the rpm of the associated internal combustion engine. This pump aspirates fuel from a fuel tank 2 and pumps it via a high-pressure fuel line 3, preferably controlled by an electrically controlled control valve, in this case a magnet valve 4, and via a check valve 5 that opens in the pumping direction, into a high-pressure fuel reservoir 6. From this reservoir, fuel lines 8 lead to fuel injection valves 9 of the engine 10. The quantity of fuel output by the fuel injection valves 9 to the engine is controlled in each case by a preferably electrically controlled valve, in the present exemplary embodiment a magnet valve 11. The triggering of these valves is effected by an electric control unit 14, which receives signals from a pressure sensor 15 that detects the pressure in the high-pressure fuel reservoir. The electric control unit also receives signals from an rpm pickup, a top dead center transducer, and for other parameters of the engine, such as the desired rpm, and engine operating conditions, and accordingly controls the fuel injection valve 9, with the aid of the magnet valves 11, in terms of the quantity of fuel and the instant of injection. The electric control unit also controls the magnet valve 4, which controls the pumping quantity of the high-pressure pump into the fuel reservoir and with this control keeps the pressure in the fuel reservoir at the desired value.

Figure 2:
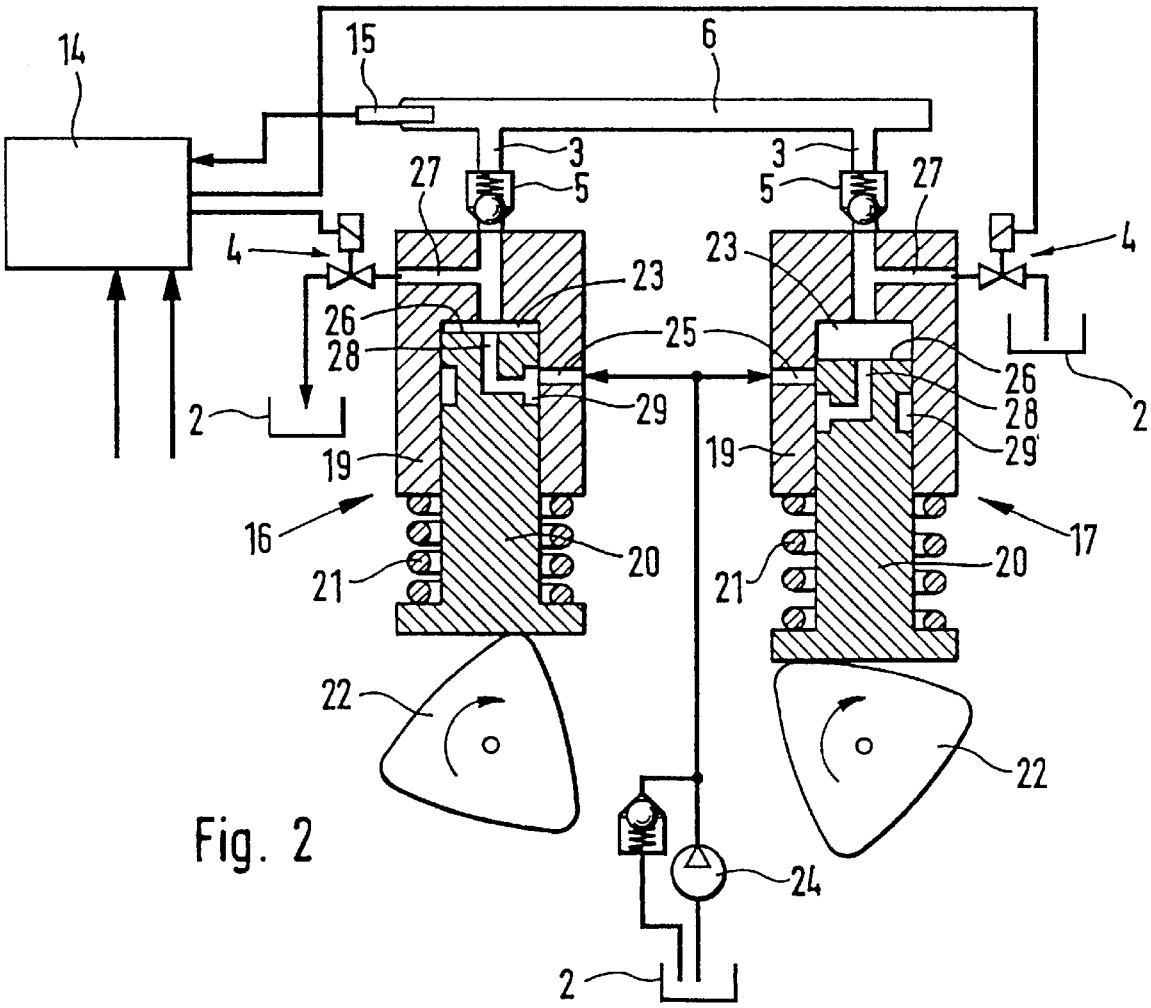
FIG. 2, a schematic illustration of the high-pressure pump with one pump element that pumps with a variable pumping quantity and one pump element that pumps with a constant pumping quantity, FIG. 3, a variant for triggering the high-pressure pump of the exemplary embodiment of FIG. 2.

The high-pressure pump, shown only symbolically in FIG. 1, with the magnet valve 4 and the check valve 5 is shown in more detail in FIG. 2. With a housing not shown, two pump elements are shown here: a first pump element 1G and a second pump element 17. Each of the pump elements has a pump cylinder 19, in which a pump piston 20, which is driven by a drive cam 22, is moved counter to the force of a spring 21. The pump pistons each enclose a work chamber 23 in the respective cylinder 19, which communicates with the high-pressure fuel reservoir 6 via a fuel pressure line, in which the pressure valve 5 that opens in the pumping direction is disposed. The filling of the pump work chamber is done via a respective filling bore 25, which at bottom dead center of the pump piston is opened by the control edge 26 of the piston, so that fuel from the tank 2, or optionally via a prefeed pump 24, can reach the pump work chamber 23 to fill it completely. In the ensuing pumping stroke, the filling bore 25 is closed by the pump piston, and the fuel present in the pump work chamber 23 is compressed. This process then leads to the high-pressure pumping into the high-pressure fuel reservoir 6, once the magnet valve 4 disposed in a relief line 27 of the pump work chamber 23 is closed. These magnet valves 4, as already noted above, are controlled by the electric control unit 14 in such a way that a desired pressure is established in the high-pressure fuel reservoir 6.

According to the invention, in the present pump element, that is, the first pump element 16, the control by the magnet valve is such that the pump work chamber 23 is closed over a certain pump piston pumping stroke, so that over this stroke high-pressure pumping into the high-pressure reservoir takes place. With the aid of a bore 28, which originates at the face end 26 of the pump piston and leads to a circumferential control groove 29 on the pump piston, it is possible to define a maximum pumping stroke of the pump piston, in that the control groove at this maximum pumping stroke connects the pump work chamber to the filling bore 25 and thus to the low-pressure chamber. Then the high-pressure pumping is preferentially initiated by a closure of the magnet valve beyond a certain pump piston stroke, and the high-pressure pumping quantity is thus controlled.

Hence with the aid of the magnet valve, the fuel pumped into the high-pressure fuel reservoir 6 is variably controlled, and this pumping in turn is dependent on the drive cam 22, which in the present example is embodied as a triple cam and thus can effect three pumping strokes of the pump piston 20 per revolution. This cam is driven with synchronous rpm, for instance with the rpm of the engine crankshaft, and is designed such that one pumping stroke of the pump piston 20 of the first pump element occurs whenever a fuel injection via one of the injection valves is required.

Figure 4:
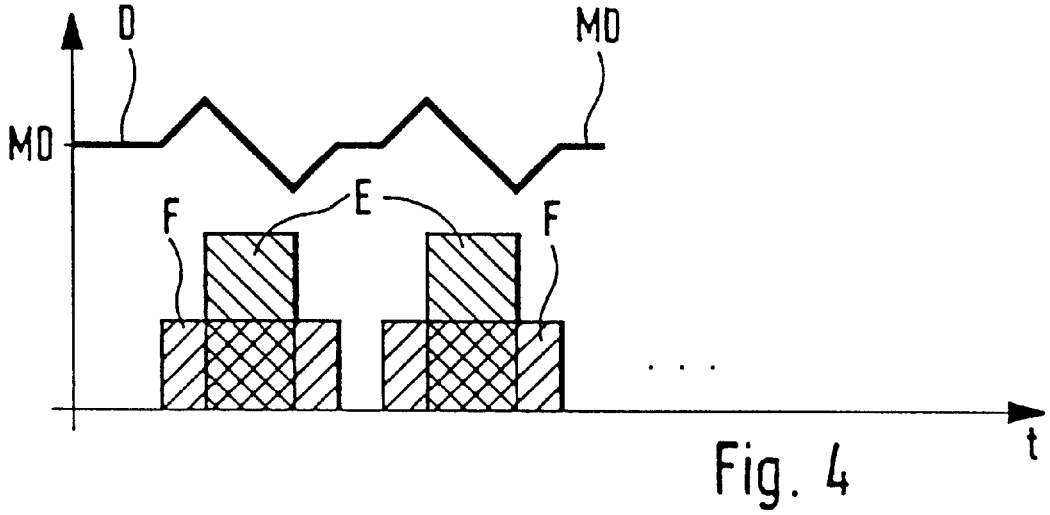
FIG. 4, a graph showing the course of pressure over the times of injection and high-pressure pumping of the high-pressure pump.

FIG. 4 schematically shows in a graph the instance at which an injection E takes place, the instance at which pumping F of the first pump element occurs, and the reaction that ensues at the pressure in the high-pressure fuel reservoir 6 having the pressure course D. It can be seen that at the onset of pumping, which lasts longer than the respective injection and occurs at an earlier time than the instant of injection, the pressure initially rises, then as the injection ensues drops, and after the end of injection can be raised to the original level again through the remainder of high-pressure pumping of the high-pressure fuel pump. Accordingly, if the high-pressure fuel pumping quantities F are adapted to the injection quantities, overall a medium pressure level md is established. In this state, the second pump element 17 is indeed driven, but because of the opened magnet valve 4 no high-pressure pumping into the high-pressure fuel reservoir takes place. The fuel moved by the pump piston 20 is fed back into the tank 2 via the open magnet valve.

Figure 5:
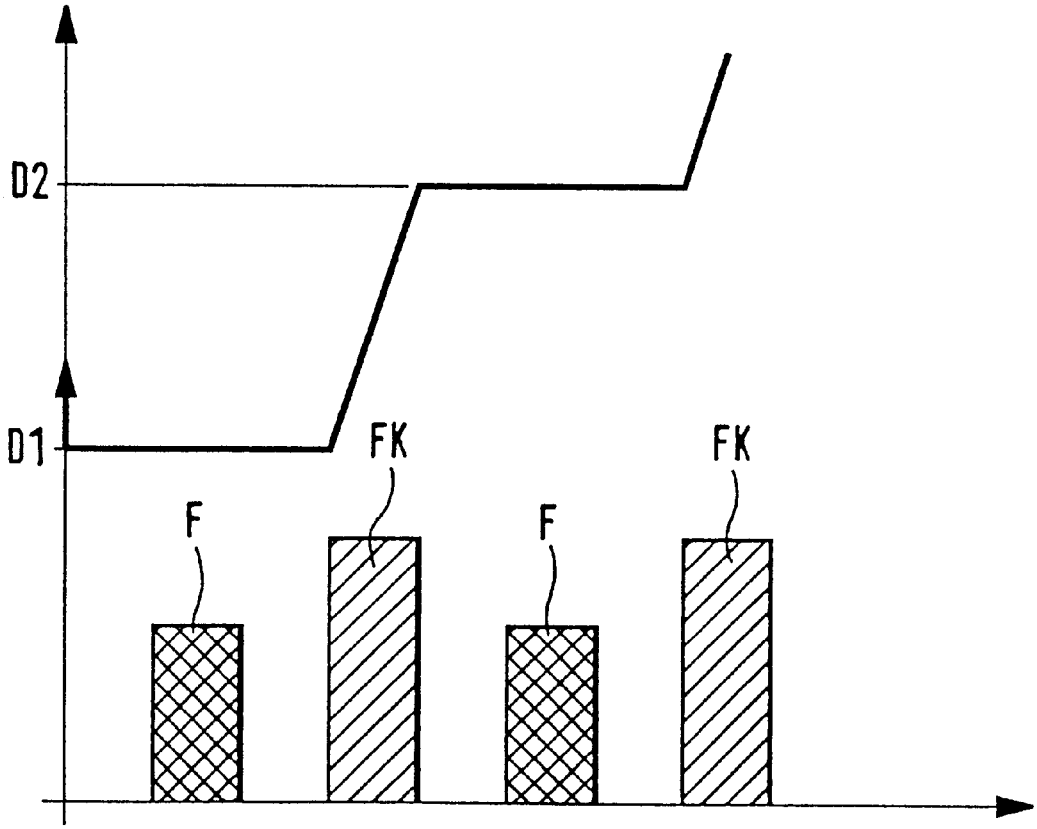
FIG. 5, the course of pressure over time for the second pump element that pumps between the individual injections.

Now, however, if because of certain engine operating conditions a higher injection pressure in the high-pressure fuel reservoir is to be established, then the second pump element is driven in the pumping direction. In that event, the magnet valve 4 of the second element 17 is closed entirely, so that the pump piston 20 of this pump element will pump the same high-pressure quantity into the high-pressure fuel reservoir with each pumping stroke. Fine regulation of the pressure in the high-pressure fuel reservoir is then undertaken by controlling the magnet valve 4 of the first pump element. The pumping may be synchronous with the pumping by the first pump element, but advantageously this constant-quantity pumping is done at times when no injection is occurring. It can be seen from FIG. 5 that this high-pressure pumping FK occurs between pumping portions F of the first pump element and thus also between the individual injections performed by the fuel injection valves. From the pressure course it can be seen that with the onset of pumping FK, the pressure level is raised from a first level D1 to a second level D2. Via the injection, this level is maintained on the basis of the pumping of the first pump element. The curve course shown in FIG. 5, with a pressure decrease upon a quantity decrease, during injection is ignored in FIG. 4.

Figure 3:
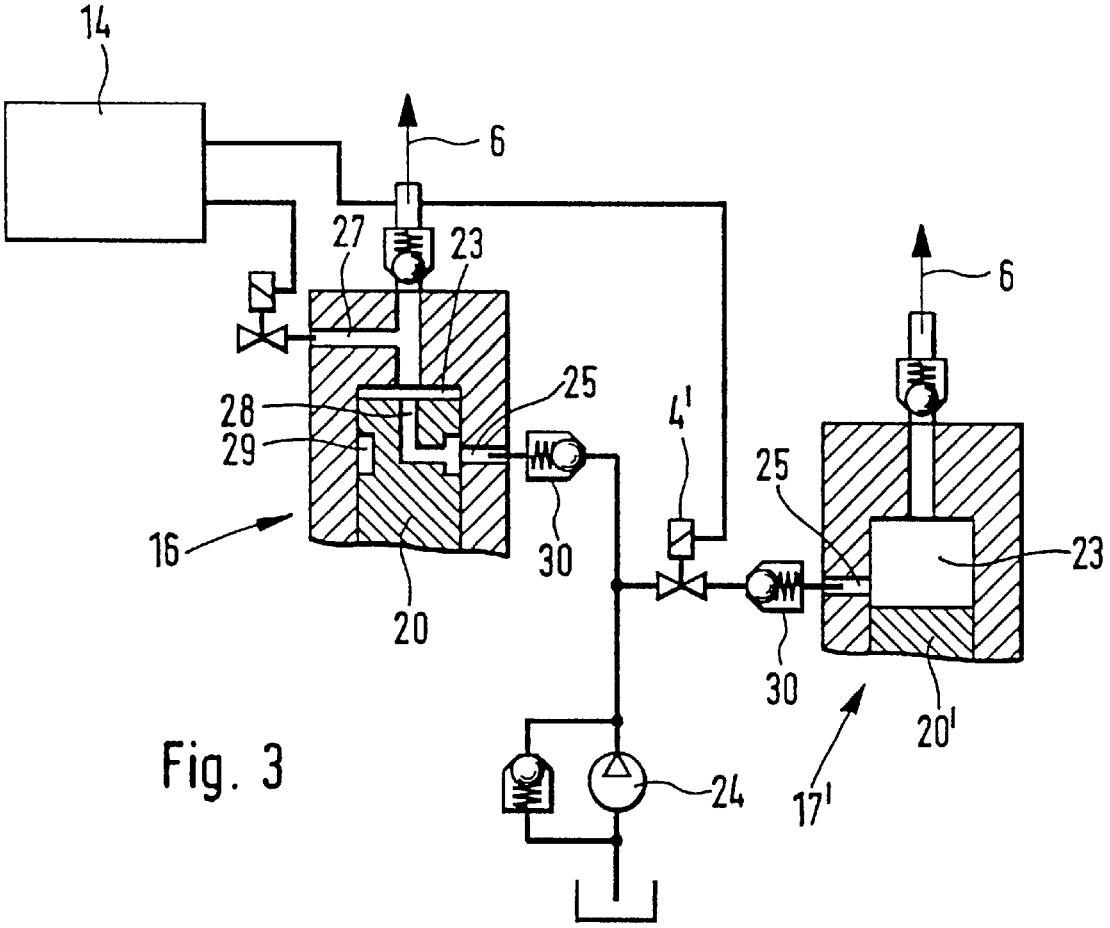

A modification of the control of the second pump element in the exemplary embodiment of FIG. 3, the control valve in the case of the second pump element 17' of FIG. 3 can be embodied as a control valve 4', in this case again in the form of a magnet valve, and instead of being disposed in a separate relief line it can now also be disposed in the inlet from the prefeed pump 24 to the pump work chamber 23 or to the filling bore 25. The relief line provided in the preceding embodiment can be omitted. For additional high-pressure pumping through the second pump element 17, the control valve 4' is now opened, to enable complete filling of the pump work chamber 23. To put the second pump element out of operation again, the control valve 4' is closed. Once again, a constant stroke of the pump element 17' is used for the high-pressure pumping when this element is turned on. Instead or in addition, for opening up the communication of the bore 28 with the filling bore 25 via the control groove 29, it is also possible to provide a communication with the pump work chamber 23 in the intake phase, and this communication can be established via a respective check valve 30. In that case, a bore 28 of the kind that was provided in FIG. 2 for furnishing a defined end of pumping stroke, becomes superfluous.

By means of this design it is possible to attain a rapid rise in the pressure level in the high-pressure reservoir, which is necessary particularly for certain instances in operation, such as acceleration or increased fuel injections during engine operation. This is done in a very simple way, with minimal electrical control expenditure and with the use of exact, fast-switching valves. The magnet valve 4 of the second element, in contrast to the magnet valve 4 of the first pump element, can be very simple in design, because it need not perform any time control functions. This embodiment is correspondingly more economical. By means of the intermediate pumping FK, a very fast reaction to desired changes with regard to the pressure level and the high-pressure reservoir is possible, making the regulation exact and fast. Instead of the number of pump elements given above, it is naturally also possible for a plurality of pump elements to be operated with regulated pumping quantity and a plurality of pump elements to be provided for a constant pumping quantity.

The foregoing relates to a preferred exemplary embodiment of the invention, it being understood that other variants and embodiments thereof are possible within the spirit and scope of the invention, the latter being defined by the appended claims.

What is claimed is:

1. A fuel injection system which comprises a high-pressure pump (1), which pumps fuel from a tank (2) into a high-pressure fuel reservoir (6), from said reservoir the fuel is delivered via fuel lines (8) to individual fuel injection valves (9), through which the fuel controlled by an electric control unit (14) is injected in metered, time-controlled fashion into the internal combustion engine, the high-pressure pump (1) includes first and second pump elements (16, 17) with pump pistons (20) that are driven by drive cams (22) moved in synchronism with the engine rpm and each pump element defines one pump work chamber (23) in a pump cylinder (19) which is supplied with fuel upon the intake stroke of the pump work chambers and from said pump work chamber, in the pumping stroke of the pump pistons (20), fuel is pumped into the high-pressure fuel reservoir (6) in a quantity controlled by first and second control valves (4), and said first pump element (16) of the pump elements is controlled by the drive cam (22) and said first control valve (4) in such a way that the high-pressure pumping is effected in chronologically synchronized fashion with the fuel injection by the fuel injection valves (9), and is controlled at each pumping stroke by said first control valve (4) for pumping fuel with variable quantities into said high-pressure fuel reservoir in dependence of the pressure of the fuel in the reservoir, said second pump element (17, 17') of the pump elements is controlled by the drive cam (22) and said second control valve (4, 4') in such a way that the second pump element is turned on or turned off with a constant high-pressure pumping quantity and as a function of operating parameters, and as a function of the pressure in the high-pressure fuel reservoir (6).

2. The fuel injection system according to claim 1, in which the second pump (17, 17') pumps fuel within a period of time located between the fuel injection events of the individual fuel injection valves (9).

3. The fuel injection system according to claim 1, in which the pump work chamber (23) of the first pump element (16) is completely filled with fuel in an intake stroke of the pump pistons (20), and the pumping quantity of the pump pistons (20) is determined by a period of time that the first and second control valves (4), located in a relief line (27) of each of the pump work chambers (20) is closed.

4. The fuel injection system according to claim 2, in which the pump work chamber (23) of the first pump element (16) is completely filled with fuel in an intake stroke of the pump pistons (20), and the pumping quantity of the pump pistons (20) is determined by a period of time that the first and second control valves (4), located in a relief line (27) of each of the pump work chambers (23) is closed.

5. The fuel injection system according to claim 1, in which the second pump element (17, 17') is operated at a constant high-pressure pumping quantity, and the high-pressure pumping is turned on or off via the second control valve (4, 4').

6. The fuel injection system according to claim 2, in which the second pump element (17, 17') is operated at a constant high-pressure pumping quantity and the high-pressure pumping is turned on or off via the second control valve (4, 4').

7. The fuel injection system according to claim 5, in which the second control valve (4') controls a fill bore (25) to the pump work chamber (23) of the second pump element (17').

8. The fuel injection system according to claim 6, in which the second control valve (4') control a fill bore (25) to the pump work chamber (23) of the second pump element (17').

9. (Amended) The fuel injection system according to claim 5, in which the second control valve (4) controls a relief line (27) to the pump work chamber (23) of the second pump element (17).

10. The fuel injection system according to claim 6, in which the second control valve (4) controls a relief line (27) to the pump work chamber (23) of the second pump element (17).

11. The fuel injection system according to claim 1, in which the drive cam (22) is a multiple cam.

12. The fuel injection system according to claim 2, in which the drive cam (22) is a multiple cam.

13. The fuel injection system according to claim 3, in which the drive cam (22) is a multiple cam.

14. The fuel injection system according to claim 4, in which the drive cam (22) is a multiple cam.

15. The fuel injection system according to claim 5, in which the drive cam (22) is a multiple cam.

16. The fuel injection system according to claim 6, in which the drive cam (22) is a multiple cam.

17. The fuel injection system according to claim 1, in which the drive cam (22) has three cams.

18. The fuel injection system according to claim 2, in which the drive cam (22) has three cams.

19. The fuel injection system according to claim 3, in which the drive cam (22) has three cams.

20. The fuel injection system according to claim 4, in which the drive cam (22) has three cams.

* * * * *

UNITED STATES PATENT AND TRADEMARK OFFICE

CERTIFICATE OF CORRECTION

PATENT NO. : 6,095,118

DATED : August 1, 2000

INVENTOR(S) : Horst Klinger et al

It is certified that error appears in the above-identified patent and that said Letters Patent are hereby corrected as shown below:

Title page: Please correct the title to read as follows:
[54] FUEL INJECTION SYSTEM

Signed and Sealed this

First Day of May, 2001

*Attest:*

Nicholas P. Godici

NICHOLAS P. GODICI

*Attesting Officer*

*Acting Director of the United States Patent and Trademark Office*